US009736570B2

(12) United States Patent
Gray

(10) Patent No.: US 9,736,570 B2
(45) Date of Patent: Aug. 15, 2017

(54) EARPHONE NOZZLE COMPRISING TRACTRIX-CURVED ACOUSTIC PASSAGE

(71) Applicant: The Quest Group, Irvine, CA (US)

(72) Inventor: Skylar Allen Gray, Irvine, CA (US)

(73) Assignee: THE QUEST GROUP, Irvine, CA (US)

( * ) Notice: Subject to any disclaimer, the term of this patent is extended or adjusted under 35 U.S.C. 154(b) by 0 days.

(21) Appl. No.: 14/509,410

(22) Filed: Oct. 8, 2014

(65) Prior Publication Data

US 2015/0098604 A1 Apr. 9, 2015

Related U.S. Application Data

(60) Provisional application No. 61/888,392, filed on Oct. 8, 2013.

(51) Int. Cl.
*H04R 25/00* (2006.01)
*H04R 1/10* (2006.01)

(52) U.S. Cl.
CPC ..... *H04R 1/1058* (2013.01)

(58) Field of Classification Search
USPC ..... 381/380, 322
See application file for complete search history.

(56) References Cited

U.S. PATENT DOCUMENTS 6,574,345 B1 * 6/2003 Huang ..... H04R 1/1016 379/430
6,738,487 B1 * 5/2004 Nageno et al. ..... 381/322
7,349,550 B2 * 3/2008 Oliveira et al. ..... 381/380

* cited by examiner

*Primary Examiner* — Amir Etesam
(74) *Attorney, Agent, or Firm* — McDermott Will & Emery LLP

(57) ABSTRACT

An earphone includes a driver and a nozzle. The driver has a transducer diaphragm. The nozzle has an internal passage having an inlet opening, an outlet opening, and a wall connecting the inlet opening and the outlet opening. The wall has an inner surface within the passage. The inner surface extends from the inlet opening to the outlet opening. The outlet opening is smaller area than the inlet opening. The inner surface is configured, based on at least one tractrix, between the inlet opening and the outlet opening. The nozzle is attached to the driver with the transducer diaphragm facing the inlet opening and the inlet opening positioned nearer to the diaphragm than is the outlet opening.

19 Claims, 6 Drawing Sheets

EARPHONE NOZZLE COMPRISING TRACTRIX-CURVED ACOUSTIC PASSAGE

CROSS-REFERENCE TO RELATED APPLICATION

This application claims the priority benefit of U.S. Provisional Patent Application No. 61/888,392, filed Oct. 8, 2013, titled EARPHONE NOZZLE COMPRISING TRACTRIX-CURVED ACOUSTIC PASSAGE, the entirety of which is incorporated by reference herein.

FIELD

The subject technology relates generally to headphones and more particularly in some embodiments to headphones fitting in the outer ear, auditory canal, or both.

BACKGROUND

Headphones are configured to be worn so that a sound transducer is placed in proximity to the wearer's ears.

SUMMARY

The subject technology is illustrated, for example, according to various aspects described below. Various examples of aspects of the subject technology are described as numbered embodiments (1, 2, 3, etc.) for convenience. These are provided as examples and do not limit the subject technology. It is noted that any of the dependent embodiments may be combined in any combination, and placed into a respective independent embodiments, to form independent embodiments. The other embodiments can be presented in a similar manner. The following is a non-limiting summary of some embodiments presented herein.

Embodiment 1

An earphone, comprising:

a driver comprising a transducer diaphragm; and a nozzle comprising an internal passage having an inlet opening, an outlet opening, and a wall connecting the inlet opening and the outlet opening, the wall comprising an inner surface within the passage, the inner surface extending from the inlet opening to the outlet opening, the outlet opening being smaller area than the inlet opening, at least a portion of the inner surface being defined by a complete revolution of a tractrix around an axis, the nozzle attached to the driver with the transducer diaphragm facing the inlet opening and the inlet opening positioned nearer to the diaphragm than is the outlet opening.

Embodiment 2

An earphone, comprising:

a driver comprising a transducer diaphragm; and a nozzle comprising an internal passage having an inlet opening, an outlet opening, and a wall connecting the inlet opening and the outlet opening, the wall comprising an inner surface within the passage, the inner surface extending from the inlet opening to the outlet opening, the outlet opening being smaller area than the inlet opening, the inner surface being longitudinally convexly curved, based on at least one tractrix, between the inlet opening and the outlet opening, the nozzle attached to the driver with the transducer diaphragm facing the inlet opening and the inlet opening positioned nearer to the diaphragm than is the outlet opening.

Embodiment 3

An earphone, comprising:

a driver comprising a transducer diaphragm; and a nozzle comprising an internal passage having an inlet opening, an outlet opening, and a wall connecting the inlet opening and the outlet opening, the wall comprising an inner surface within the passage, the inner surface extending from the inlet opening to the outlet opening, the outlet opening being smaller area than the inlet opening, all longitudinal arcs of the inner surface being convex, based on at least one tractrix, between the inlet opening and the outlet opening, the nozzle attached to the driver with the transducer diaphragm facing the inlet opening and the inlet opening positioned nearer to the diaphragm than is the outlet opening.

Embodiment 4

An earphone, comprising:

a driver comprising a transducer diaphragm; and a nozzle comprising an internal passage having an inlet opening, an outlet opening, and a wall connecting the inlet opening and the outlet opening, the wall comprising an inner surface within the passage, the inner surface extending from the inlet opening to the outlet opening, the outlet opening being smaller area than the inlet opening, the passage extending along a passage axis, wherein any plane including the axis intersects the inner surface at at least two intersection lines, at least a segment of each intersection line having a curvature based on a tractrix, the nozzle attached to the driver with the transducer diaphragm facing the inlet opening and the inlet opening positioned nearer to the diaphragm than is the outlet opening.

Embodiment 5

The earphone of Embodiment 4, wherein the passage axis is forms a non-zero angle with a central axis of sound propagation of the transducer diaphragm.

Embodiment 6

The earphone of Embodiment 4, wherein the passage axis is parallel to a central axis of sound propagation of the transducer diaphragm.

Embodiment 7

The earphone of Embodiment 6, wherein the passage axis is coaxial with the central axis of sound propagation.

Embodiment 8

The earphone of any of Embodiments 1-4, wherein the tractrix extends from the inlet opening toward the outlet opening.

Embodiment 9

The earphone of Embodiment 8, wherein the tractrix extends to the outlet opening.

Embodiment 10

The earphone of any of Embodiments 1-4, wherein the inner surface comprises a cylindrical portion, wherein the cylindrical portion is positioned between the tractrix and the outlet opening.

Embodiment 11

The earphone of any of Embodiments 1-4, wherein the transducer diaphragm has an effective area of sound propagation, the effective area having an effective radius, the outlet opening having an outlet radius, the effective radius being longer than the outlet radius, wherein the tractrix is defined according to $$x = a\operatorname{sech}^{-1}\left(\frac{y}{a}\right) - \sqrt{a^2 - y^2},$$

wherein:

"a" is substantially equal to the difference in length between the effective radius and the outlet radius;

"x" is measured in a direction parallel to a central axis of sound propagation of the transducer diaphragm; and "y" is measured in a direction normal to the central axis.

Embodiment 12

The earphone of Embodiment 11, wherein the length of the passage along a longitudinal axis of the passage from the inlet opening to the outlet opening is within 20% of a diameter of the transducer diaphragm.

Embodiment 13

The earphone of Embodiment 12, wherein the length of the passage is within 10% of the diameter of the transducer diaphragm.

Embodiment 14

The earphone of Embodiment 11 or Embodiment 12, wherein the length of the passage is greater than the diameter of the transducer diaphragm.

Embodiment 15

The earphone of Embodiment 11, wherein a ratio of the effective radius to the outlet radius is between 1.25 and 2.5.

Embodiment 16

The earphone of Embodiment 11, wherein a ratio of the effective radius to the outlet radius is between 1.5 and 2.25.

Embodiment 17

The earphone of Embodiment 11, wherein a ratio of the effective radius to the outlet radius is between 1.75 and 20.

Embodiment 18

The earphone of Embodiment 11, wherein a ratio of the effective radius to the outlet radius is between 1.8 and 1.9.

Embodiment 19

The earphone of Embodiment 11, wherein a ratio of the effective radius to the outlet radius is approximately 1.83.

Embodiment 20

The earphone of any of Embodiments 1-4, wherein an x-axis of the tractrix is parallel to, and offset from, a central axis of the passage.

Embodiment 21

The earphone of any of Embodiments 1-4, wherein a tangent angle of the tractrix at the inlet opening is normal to a central axis of sound propagation of the transducer diaphragm.

Embodiment 22

The earphone of any of Embodiments 1-4, wherein the outlet opening has a smaller area than has the inlet opening.

Embodiment 23

The earphone of any of Embodiments 1-4, wherein the outlet opening has a smaller radius than has the inlet opening.

Embodiment 24

The earphone of any of Embodiments 1-4, wherein the inner surface is circumferentially and longitudinally contiguous from the inlet opening to the outlet opening.

Embodiment 25

The earphone of any of Embodiments 1-4, wherein the inner surface comprises no hole between the inlet opening and the outlet opening.

Embodiment 26

The earphone of any of Embodiments 1-4, wherein the inner surface comprises no corner between the inlet opening and the outlet opening.

Embodiment 27

The earphone of any of Embodiments 1-4, wherein the inner surface comprises no edge between the inlet opening and the outlet opening.

Embodiment 28

The earphone of any of Embodiments 1-4, wherein the transducer diaphragm has an effective area of sound propagation, and the inlet opening is congruent with a perimeter of the effective area.

Embodiment 29

The earphone of any of Embodiments 1-4, wherein the transducer diaphragm has an effective area of sound propagation, and an area of the inlet opening is smaller than the effective area.

Embodiment 30

The earphone of any of Embodiments 1-4, wherein the transducer diaphragm has an effective area of sound propagation, and an area of the inlet opening is larger than the effective area.

Embodiment 31

The earphone of any of Embodiments 1-4, wherein the transducer diaphragm has an effective area of sound propagation, and a maximum transverse dimension of the inlet opening is smaller than a maximum transverse dimension of the effective area.

Embodiment 32

The earphone of any of Embodiments 1-4, wherein the transducer diaphragm has an effective area of sound propagation, and a maximum transverse dimension of the inlet opening is larger than the maximum transverse dimension of the effective area.

Embodiment 33

The earphone of any of Embodiments 29-32, wherein the inlet opening is substantially the same shape as a perimeter of the effective area.

Embodiment 34

The earphone of any preceding Embodiment, further comprising a housing member, an ear tip, and a wire, the housing member attached to the nozzle and positioned opposite the nozzle relative to the driver, the ear tip attached to the nozzle and configured to engage an auditory canal of a human ear, and the wire connecting the driver to a connector configured for attachment to a signal source.

Additional features and advantages of the subject technology will be set forth in the description below, and in part will be apparent from the description, or may be learned by practice of the subject technology. The advantages of the subject technology will be realized and attained by the structure particularly pointed out in the written description and claims hereof as well as the appended drawings.

It is to be understood that both the foregoing general description and the following detailed description are exemplary and explanatory and are intended to provide further explanation of the subject technology as claimed.

BRIEF DESCRIPTION OF THE DRAWINGS

The accompanying drawings, which are included to provide further understanding of the subject technology and are incorporated in and constitute a part of this description, illustrate aspects of the subject technology and, together with the specification, serve to explain principles of the subject technology.

DETAILED DESCRIPTION

The detailed description set forth below is intended as a description of various configurations of the subject technology and is not intended to represent the only configurations in which the subject technology may be practiced. The detailed description includes specific details for the purpose of providing a thorough understanding of the subject technology. However, the subject technology may be practiced without these specific details. In some instances, well-known structures and components are not shown, or are shown schematically or in block diagram form, to avoid obscuring the concepts of the subject technology.

Figure 1:
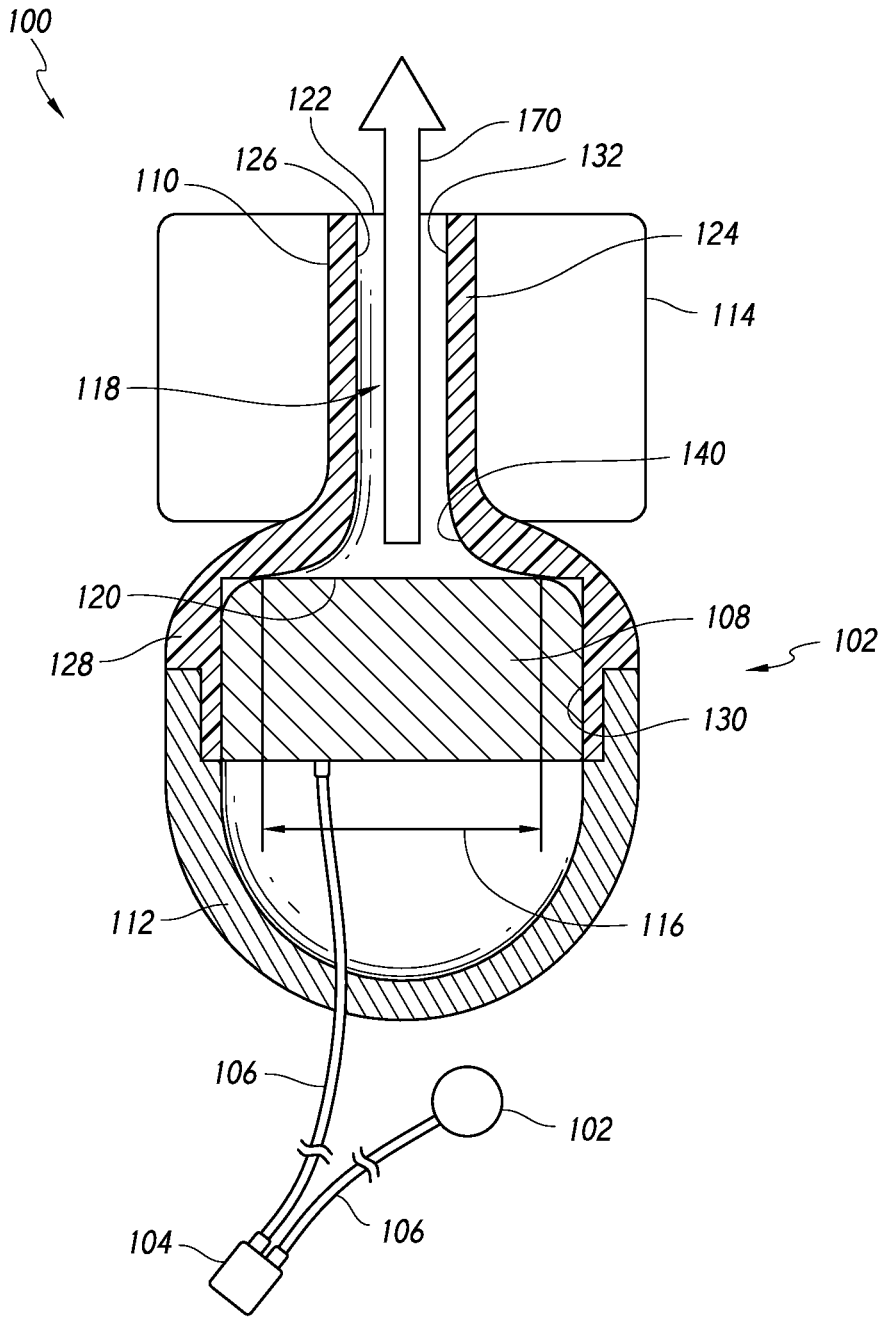
FIG. 1 is a schematic illustration of an earphone set, according to embodiments of the subject technology, with an earphone shown in cross-section.

FIG. 1 is a schematic illustration of an earphone set 100, according to embodiments of the subject technology. FIG. 1 shows the earphone set 100 comprising two earphones 102 connected to the same connector 104. One earphone 102 is shown in cross-section and another earphone 102 represented by a circle. The two earphones 102 can be identical configuration and construction in some embodiments, and can be of different constructions and configurations in some embodiments. In some embodiments, earphone set 100 comprises two earphones each having a configuration that is mirrored compared to the other, such as, for example, to fit respectively into right and left ears. In some embodiments, an earphone set 100 can comprise a single earphone 102, or more than two earphones 102. The earphones can be configured either to be inserted into an ear canal or to be fitted in the outer ear without extending into the ear canal.

In FIG. 1, the earphones 102 are connected to a connector 104 by wires 106. The connector 104 is configured for connection to a signal source. Although the earphones 102 and the connector 104 are shown as connected by wires 106 and FIG. 1, the earphones 102 can be wirelessly connected to the connector 104 in some embodiments. The connector 104 comprise, for example, an industry standard connector, such as a ¼ inch plug, ⅛ inch (3.5 mm) plug, 2.5 mm plug, or USB connector, or a nonstandard connector. In some embodiments, the connector 104 can comprise a wireless transmitter or transceiver that is integrated with or separate from a signal source, and is operatively wirelessly connected to one or more earphones 102, such as, for example, by one or more wireless communication protocols known to those of skill in the art. In some embodiments, the connector 104 can be wirelessly connected to one or more earphones 102 and wirelessly connected to a signal source.

As illustrated in FIG. 1, an earphone 102 can comprise a driver 108, a nozzle 110, a housing member 112, and an ear tip 114. FIG. 1 shows the nozzle 110 and the housing member 112 together forming a housing with the driver 108 positioned therein. The ear tip 114 can attached to the nozzle, e.g., as illustrated in FIG. 1, the housing member, or both.

The driver 108 can comprise a transducer diaphragm and can be configured to receive an input signal, and to create sound waves in response to the input signal. The transducer diaphragm has an effective area of sound propagation. The effective area can be smaller than a total surface area of the transducer diaphragm. In FIG. 1, the effective area of sound propagation is circular and has an effective diaphragm diameter 116 characterizing the effective area. The effective diameter 116 can be determined, without undue experimentation, from the common Thiele-Small mechanical parameter Sd. In some embodiments, the effective area of sound propagation can be noncircular and can have a characterizing dimension, such as, for example, a major diameter, a minor diameter, a maximum transverse dimension, minimum transverse dimension, or other dimension. In some embodiments, the driver can comprise a dynamic, moving coil.

As illustrated in FIG. 1, the nozzle 110 can comprise an internal, acoustic passage 118, also herein referenced as the internal passage, the acoustic passage or the passage 118, an inlet opening 120 of the acoustic passage, an outlet opening 122 of the acoustic passage, and a wall 124 connecting the inlet opening and the outlet opening. The wall comprises an inner surface 126, within the passage 118, extending from the inlet opening to the outlet opening. The outlet opening 122 is smaller area than the inlet opening 120. In some embodiments, the outlet opening has a smaller area than has the inlet opening. In some embodiments, the outlet opening and the inlet opening are circular, and the outlet opening has a smaller radius than has the inlet opening.

In FIG. 1, the nozzle 110 is attached to the driver 108 with the transducer diaphragm facing the inlet opening 120, and the inlet opening 120 positioned nearer to the diaphragm than is the outlet opening 122. In some embodiments, the inlet opening can be congruent with a perimeter of the effective area of sound propagation. In some embodiments, an area of the inlet opening can be smaller or larger than the effective area. The inlet opening can be substantially the same shape as a perimeter of the effective area in some embodiments. In some embodiments, a maximum transverse dimension of the inlet opening is smaller than a maximum transverse dimension of the effective area, while in other embodiments, the maximum transverse dimension of the inlet opening can be larger than the maximum transverse dimension of the effective area.

The nozzle 110 is attached directly to the driver 108 as in FIG. 1. The nozzle 110 can comprise a portion 128 configured to position the driver 108 relative to the nozzle, to orient the driver relative to the nozzle, to secure the driver to the nozzle, or a combination thereof. For example, the nozzle 110 can comprise a surface 130 that positions and orients the driver relative to the nozzle, for example as illustrated in FIG. 1. In some embodiments, the nozzle can be indirectly attached to the driver. For example, the driver 108 can be directly attached to the housing member in additional or alternative to direct attachment to the nozzle 110. One or more components, e.g., a housing member 112, other than the nozzle can be configured to position the driver relative to the nozzle, to orient the driver relative to the nozzle, to secure the driver to the nozzle, or a combination thereof instead of, or in cooperation with, the nozzle.

In FIG. 1, the housing member 112 is attached to the nozzle 110, and positioned opposite the nozzle relative to the driver 108. If present, the wire 106 can extend through the housing member 112, for example as illustrated in FIG. 1, through the nozzle 110, or between the nozzle 110 and the housing member 112. In some embodiments, the connector 104 can be directly attached to the nozzle 110, the housing member 112, or both.

In FIG. 1, the ear tip 114 is attached directly to the nozzle 110. In some embodiments, the ear tip can be attached directly to the housing member 112 in addition or alternative to the nozzle 110. The ear tip is configured to engage an auditory canal, e.g., of a human ear. The ear tip is shown schematically in FIG. 1. Details regarding the configuration and construction of ear tips and attachment of ear tips to a nozzle, housing member, or both are known to those of ordinary skill in the art. In some embodiments, the ear tip can be configured to create a seal against an auditory canal or other ear portion. In some embodiments, an earphone 102 can omit an ear tip 114, and in some such embodiments the nozzle 110 can be configured for insertion into and/or engagement with an auditory canal without an ear tip.

Figure 2A:
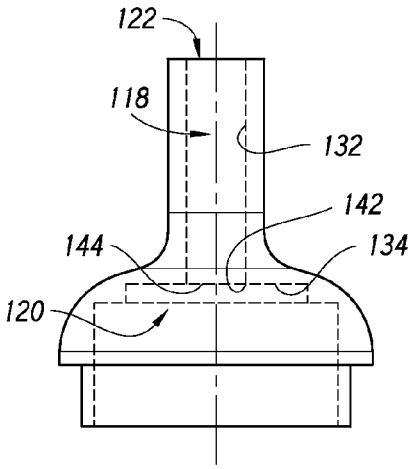
FIG. 2A Prior Art
FIGS. 2A-2C schematically illustrate nozzles comprising prior art configurations of acoustic passages.
Figure 2B:
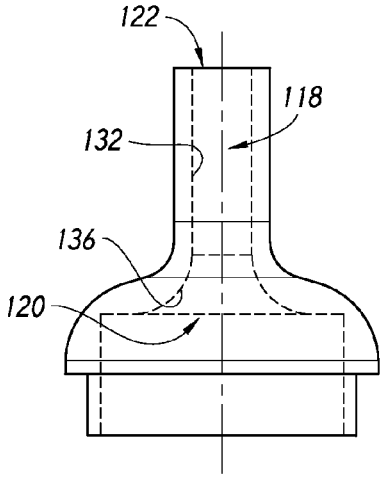
FIG. 2B Prior Art
Figure 2C:
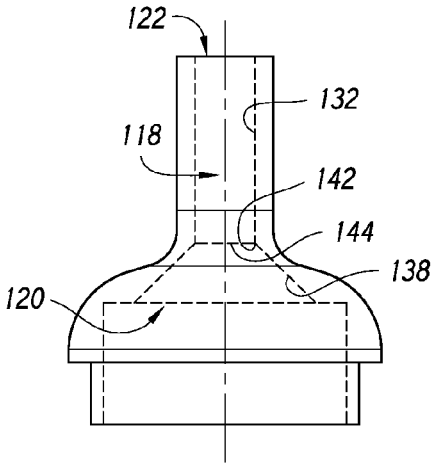
FIG. 2C Prior Art

FIGS. 2A-2C schematically illustrate nozzles comprising prior art configurations of acoustic passages 118 comprising a transition between an inlet opening 120 and a smaller outlet opening 122. The transitions can join the inlet opening 120 with a cylindrical portion 132 that extends to the outlet opening. Conventional transitions include right-angle steps 134 (FIG. 21), arbitrary curves 136 (FIG. 2B), and frustoconical tapers 138 (FIG. 2C). Such transitions can distort sound propagating from a driver and through the acoustic passage by introducing reflections, wave interference, resonances, or a combination thereof.

Figure 3:
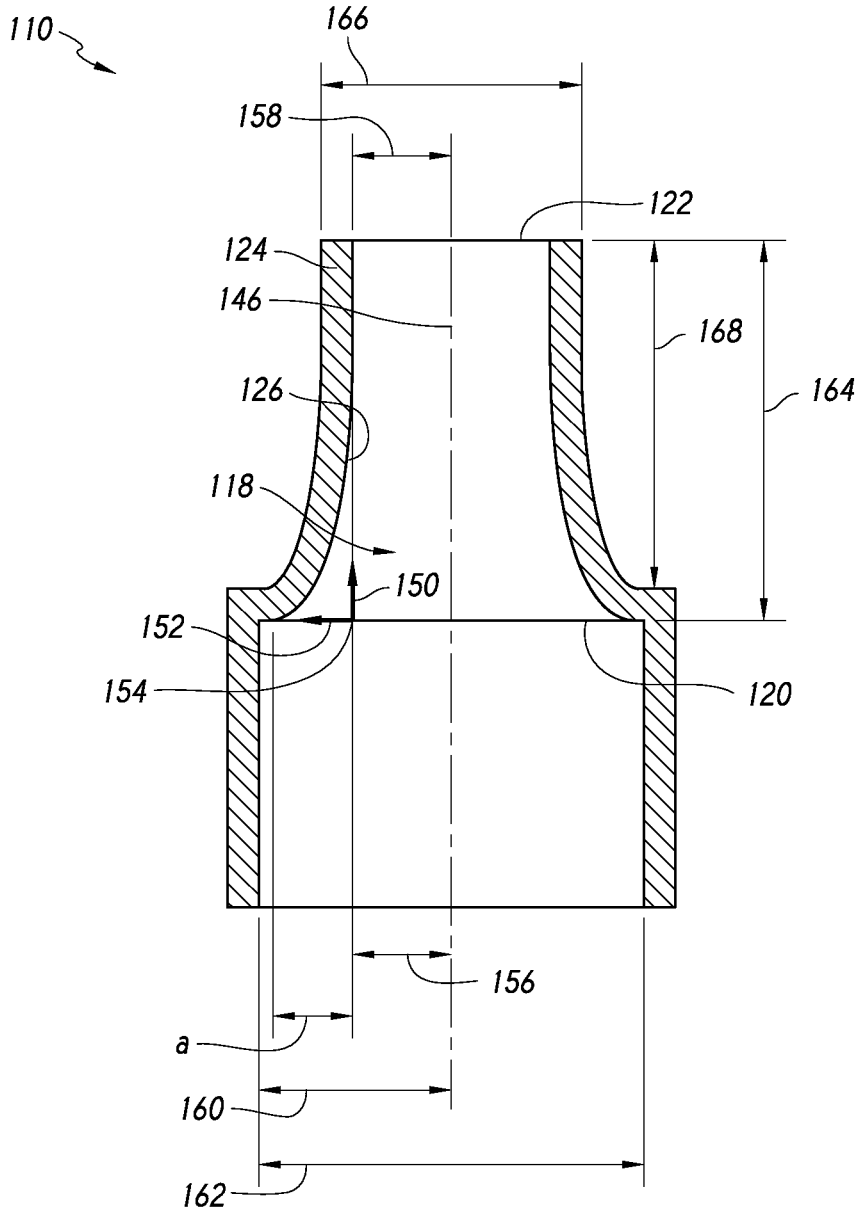
FIG. 3 is a plan view of a nozzle, according to embodiments of the subject technology.

FIG. 3 is a plan view of a nozzle, according to embodiments of the subject technology, comprising an acoustic passage 18 configured based on a tractrix. In some embodiments of the subject technology wherein an acoustic passage 18 of the nozzle 110 is configured based on a tractrix, e.g., comprising a curve derived from the tractrix equation and revolved around a central axis, reduce internal reflections, resonances, and distortion of sound propagating through the acoustic passage can be reduced, e.g., compared to acoustic passages of the types illustrated in FIGS. 2A-2C, or eliminated. In some embodiments, the acoustic passage can comprise a first surface 140 based on a tractrix and a second, cylindrical surface 132.

In some embodiments, the inner surface is circumferentially and longitudinally contiguous from the inlet opening to the outlet opening, for example as illustrated in FIG. 3. In some embodiments, the inner surface 126 of the acoustic passage 118 comprises no hole between the inlet opening 120 in the outlet opening 122. In some embodiments, the inner surface comprises no corner 142 (FIGS. 2A and 2C) between the inlet opening 120 and the outlet opening 122. In some embodiments, the inner surface comprises no edge 144 (FIGS. 2A and 2C) between the inlet opening and the outlet opening.

In FIG. 3, the inner surface 126 of the passage 118 in the nozzle 110 is partially or entirely defined by a complete revolution, about an axis 146, of a curve 148 derived from a tractrix. In some embodiments, the curve 148 is a tractrix. In some embodiments, at least a portion of the inner surface 118 is defined by a complete revolution of a tractrix around the axis 146. The curve 146 can have a convex curvature, based on at least one tractrix. In some embodiments, all longitudinal arcs of the inner surface 118 are convex with a curvature based on at least one tractrix.

Figure 4:
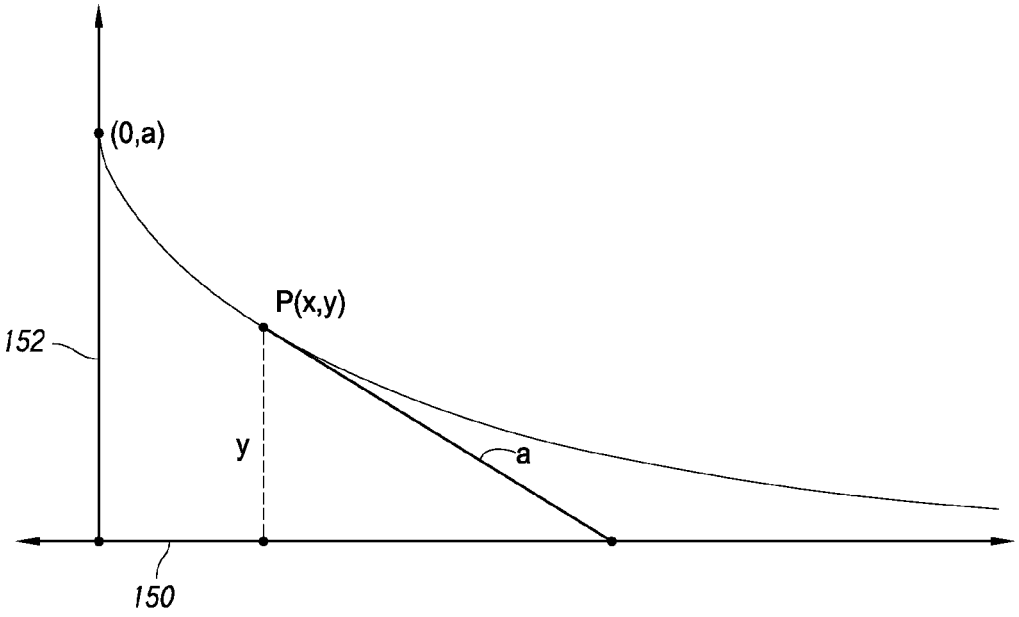
FIG. 4 illustrates an example of a tractrix.

FIG. 4 illustrates an example of a tractrix, which is defined by Eq. 1.

$$x = a\,\mathrm{sech}^{-1}\left(\frac{y}{a}\right) - \sqrt{a^2 - y^2} \qquad \text{Eq. 1}$$

In Eq. 1, "a" is the tangent length shown in FIG. 4.

In FIG. 3, the x-axis 150 of the tractrix is parallel to the axis 146 of revolution and to an axis of sound propagation of the transducer diaphragm, and the y-axis 152 of the tractrix is normal to the axis 146 of revolution and to an axis of sound propagation of the transducer diaphragm. As discussed below, the axis 146 of revolution and the axis of sound propagation of the transducer diaphragm can be nonparallel in some embodiments. In some embodiments, the x-axis of the tractrix can be parallel to an axis of revolution, to an axis of sound propagation of the transducer diaphragm, both of them, or neither of them. In some embodiments, the y-axis of the tractrix can be normal to an axis of revolution, to an axis of sound propagation of the transducer diaphragm, both of them, or neither of them.

In some embodiments, an origin 154 of the coordinate system of the tractrix can be aligned with the inlet opening 120, and offset from the axis 146 of revolution by an offset distance 156. For example, the y-axis 152 can lie in a common plane with the inlet opening 120. The offset distance 156 can have a length equal to, slightly smaller than, or substantially the same as a radius 158 of the outlet opening 122 so that an endpoint of the tractrix is the same distance from the axis 146 as a length of the outlet radius 158. The magnitudes of the offset distance 156 and the outlet radius 158 can be somewhat different in some embodiments to account for the asymptotic character of the tractrix relative to the x-axis and the utilized length of the tractrix.

The tangent "a" can be equal to the difference in length between (i) the effective radius 160 of the effective area of the transducer diaphragm (i.e., one half of the effective diameter 116) and (ii) the outlet radius 158. As noted above, the effective diameter 116 can be less than a total diameter 162 of the driver 108. In some embodiments, the tangent "a" can have a length equal to, slightly larger than, or substantially the same as the difference in length between (i) the effective radius 160 and (ii) the outlet radius 158, so that an endpoint of the tractrix is the same distance from the axis 146 as a length of the outlet radius 158, to account for the asymptotic character of the tractrix relative to the x-axis and the utilized length of the tractrix.

Although tractrix-based acoustic passages 118 are described herein with reference to diameters and radii, it should be appreciated that neither the driver 108, the transducer diaphragm, the inlet opening 120, the outlet opening 122, nor any cross-section of the passage 118 normal to the axis 146 of revolution need be circular. The subject technology can likewise be practiced with other shapes, including arbitrary shapes, ovals, and polygons. Thus, diameters and radii referenced herein can be substituted by analogous characteristic dimensions, such as, for example, major diameters and radii, minor diameters and radii, transverse dimensions from an axis to a perimeter of the referenced feature, etc.

In FIG. 3, the acoustic passage 118 has a nominal length 164, measured along the axis 146, from the transducer diaphragm to the outlet opening 122. In some embodiments, the length 164 can be measured from the inlet opening 120, such as, for example, when the transducer diaphragm is nominally positioned at the inlet opening.

The nominal length 164 and the outlet radius 158 are selected for a balance between ergonomics and resonant performance. The outside diameter 166 of the nozzle 110 must be larger than the internal diameter by some amount to maintain structural integrity and manufacturability. The difference between the outside diameter 166 of the nozzle 110 and the outlet diameter (i.e., double the outlet radius 158), depends upon multiple factors, including material(s) and process(es) used to manufacture the nozzle. In some embodiments, the nozzle outside diameter is 0.5 mm-2 mm larger than the outlet diameter. However, reduction of the outside diameter 166 is desirable for the earphone to both fit into a larger range of ear canals and be more comfortable to wear over long periods of time (e.g., more than 2 hours). As the outside diameter 166 is decreased, so is the inside diameter, and thus the acoustic pathway becomes more narrow. As this pathway becomes narrower, resonant peaks in the frequency response undesirably shift downward into the audible spectrum. To counteract this effect, the pathway length 164 can be shortened, though care must be taken to ensure that the nozzle length 168 remains adequate for secure attachment of an ear tip 114, if present, and, if desired, to promote a good seal in the auditory canal.

An increase in the effective size of the transducer diaphragm typically results in overall increase in earphone size, which negatively impacts comfort and makes the earphone increasingly incompatible with smaller ears. A reduction in the effective size of the transducer diaphragm can permit the earphone to be made smaller in overall size, which can lead to a more comfortable earphone that is compatible with a larger range of ears. A change, increase or decrease in the effective size of the transducer diaphragm can have positive or negative acoustic performance implications based on many factors of underlying transducer design.

An increase in the outlet radius 158 (i) can increase of the nozzle outer diameter 166, which negatively impacts comfort and makes the earphone increasingly incompatible with smaller ears, and (ii) can shift primary resonance peaks higher in frequency, potentially becoming less perceivable or inaudible. On the other hand, a decrease in the outlet radius 158 (i) can permit the nozzle outside diameter to be made smaller, which can lead to a more comfortable earphone that is compatible with a larger range of ears, and (ii) can shift primary resonance peaks lower in frequency and high frequencies can become attenuated, potentially resulting in an undesirable or even unpleasing sound signature.

An increase in the length 164 of the acoustic passage (i) results in a longer nozzle which can be uncomfortable due to greater insertion depth into the ear canal, and (ii) can shift secondary resonance peaks lower in frequency, potentially resulting in an undesirable or unpleasing sound signature, but increases sound pressure level at the ear drum. On the other hand, a decrease in the length 164 of the acoustic passage (i) can permit the nozzle to be made shorter which can result in a more shallow insertion depth for increased comfort, and (ii) can shift secondary resonance peaks shift higher in frequency, potentially becoming less perceivable or inaudible, but sound pressure level at the ear drum is decreased.

In some embodiments, the length 164 of the acoustic passage can be, for example, within 20%, with 10%, or within 5% of the effective diameter 116 of the transducer diaphragm. In some embodiments, the length 164 of the acoustic passage can be greater than the effective diameter 116 or total diameter 162 of the transducer diaphragm.

As the tangent length "a" becomes smaller (indicating a smaller difference between the transducer diaphragm and nozzle inside diameter dimensions), the area under the tractrix curve gets smaller, the curve gets tighter, and opposing inner surfaces 126 of the nozzle 110 become closer to parallel. As the walls become more parallel, manufacture of the earphone may become easier depending upon the process chosen. Past a certain point, dependent on the parameters above, as the tractrix curve gets smaller or larger, measured distortion can begin to increase. Thus, in view of this disclosure, appropriate parameters for the tractrix can be selected such that frequency response and distortion are optimized to yield a preferred sound quality. In some embodiments, a ratio of the effective radius 160 to the outlet radius 158 is, for example, from 1.25 to 2.5, from 1.5 to 2.25, from 1.75 to 2.0, from 1.8 to 1.9, or approximately 1.83.

In some embodiments, the outlet radius 158 can be, for example, 1.5 to 2 mm. In some embodiments, the effective diameter 116 of the transducer diaphragm can be, for example, 4 to 7 mm, 5 to 6 mm, or 5.5 approximately mm.

In some embodiments, the tractrix extends from the inlet opening 120 toward the outlet opening 122. In some embodiments, a tangent angle of the tractrix at the inlet opening 120 is normal to the axis 146 of revolution, an axis 170 of sound propagation of the transducer diaphragm, both of them, or neither of them.

The tractrix extends to the outlet opening 122 in some embodiments. In some embodiments, the inner surface 126 comprises a cylindrical portion 132 positioned between an end of the tractrix nearest to the outlet opening and the outlet opening.

Figure 5:
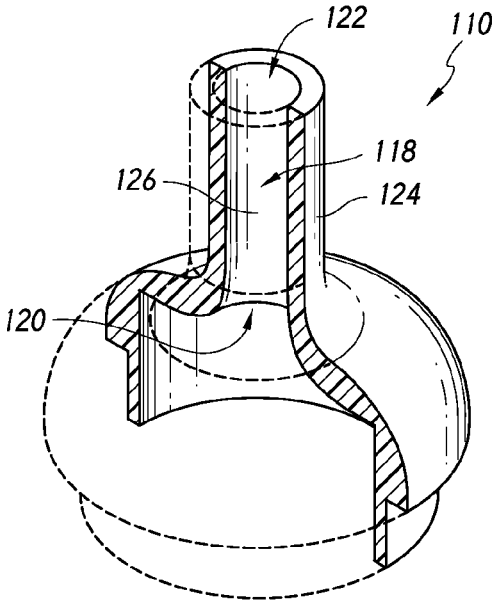
FIG. 5 is a perspective cross-sectional view of a nozzle, according to embodiments of the subject technology.

The tractrix can be revolved a complete revolution about the axis 146 to define the inner surface 126 of the inner passage 118, for example as illustrated in the perspective cross-sectional view of FIG. 5.

Figure 6:
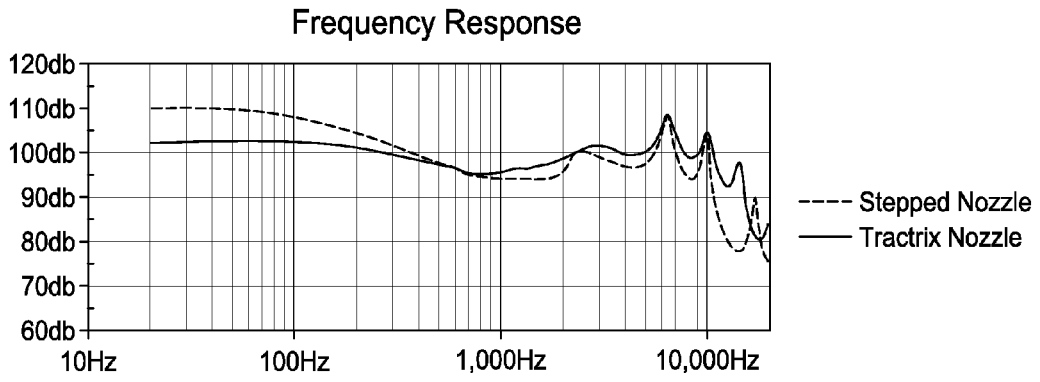
FIG. 6 is a plot comparing frequency responses of two nozzles. One of the nozzles comprises an acoustic passage having a shape based on a tractrix, according to embodiments of the subject technology. The other nozzle comprises an acoustic passage having a stepped shape.
Figure 7:
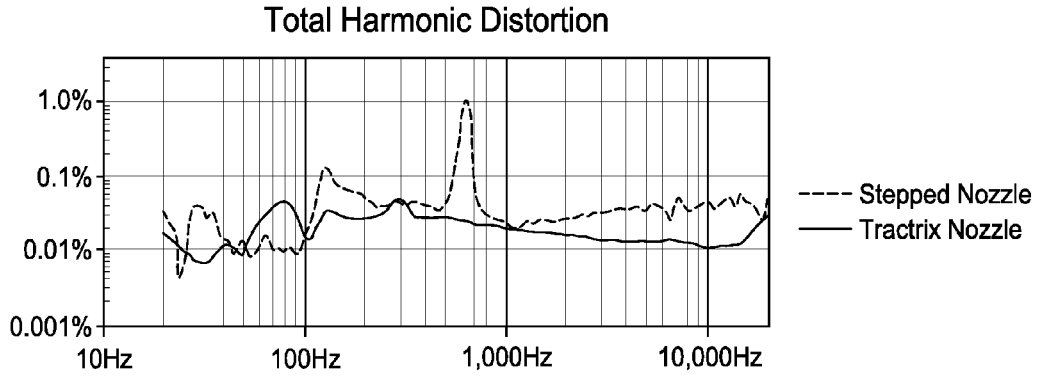
FIG. 7 is a plot comparing total harmonic distortion of the two nozzles of FIG. 6.

FIGS. 6 and 7 are plots comparing frequency responses and total harmonic distortions, respectively, of two nozzles. One of the nozzles comprises an acoustic passage having a shape based on a tractrix, according to embodiments of the subject technology. The other nozzle comprises an acoustic passage having a stepped shape. As indicated in FIG. 6, the tractrix-based nozzle produces a flatter frequency response over frequencies from 20 Hz to 20,000 Hz than does the nozzle with the stepped shape. FIG. 7 indicates that the tractrix-based nozzle also produces less total harmonic distortion over frequencies from 20 Hz to 20,000 Hz than does the nozzle with the stepped shape.

Figure 8:
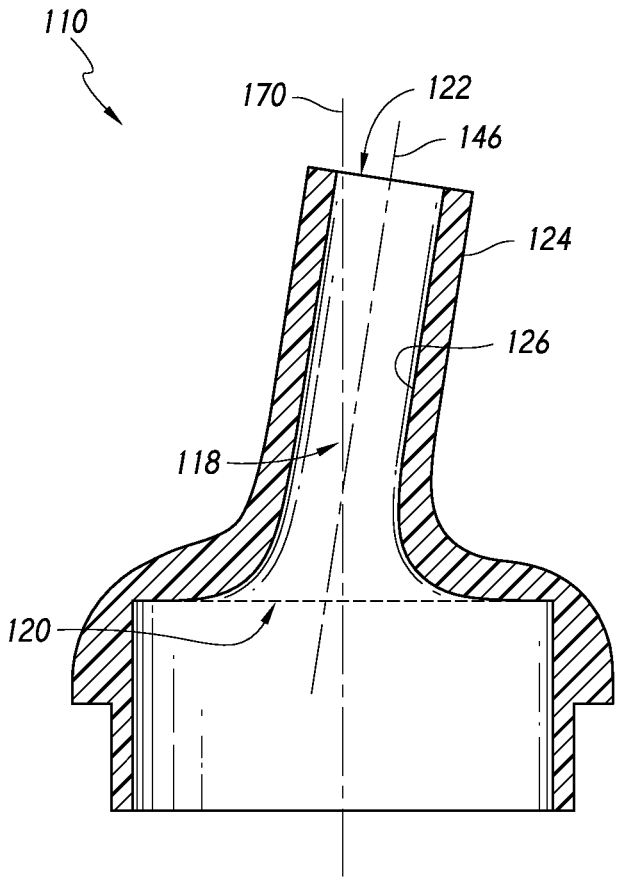
FIG. 8 is a cross-sectional view of a nozzle, according to embodiments of the subject technology.

In some embodiments, for example as illustrated in the cross-sectional view of FIG. 8, the axis 146 of revolution of the internal passage 118 and the axis 170 of sound propagation are not parallel. The tractrix can be varied depending upon the orientation of the tractrix about the axis 146. For example, the tractrix curvatures on opposing sides of the axis 146 can be stretched and/or shrunk compared to the other to provide the non-zero angle between the axis 146 and the axis 170. In some embodiments, a tractrix curve at each angle of orientation about the axis 146 can be determined based on the parameters of the nozzle on that side of the axis. In some embodiments, any plane including the axis (e.g., the cross-section plane of FIG. 8) intersects the inner surface at at least two intersection lines, and at least a segment of each intersection line has a curvature based on a tractrix. The tractrix parameters at each orientation about the axis 146 can be unique in some embodiments.

The foregoing description is provided to enable a person skilled in the art to practice the various configurations described herein. While the subject technology has been particularly described with reference to the various figures and configurations, it should be understood that these are for illustration purposes only and should not be taken as limiting the scope of the subject technology.

There may be many other ways to implement the subject technology. Various functions and elements described herein may be partitioned differently from those shown without departing from the scope of the subject technology. Various modifications to these configurations will be readily apparent to those skilled in the art, and generic principles defined herein may be applied to other configurations. Thus, many changes and modifications may be made to the subject technology, by one having ordinary skill in the art, without departing from the scope of the subject technology.

It is understood that the specific order or hierarchy of steps in the processes disclosed is an illustration of exemplary approaches. Based upon design preferences, it is understood that the specific order or hierarchy of steps in the processes may be rearranged. Some of the steps may be performed simultaneously. The above listing of exemplifying method embodiments present elements of the various steps in a sample order, and are not meant to be limited to the specific order or hierarchy presented.

As used herein, the phrase "at least one of" preceding a series of items, with the term "and" or "or" to separate any of the items, modifies the list as a whole, rather than each member of the list (i.e., each item). The phrase "at least one of" does not require selection of at least one of each item listed; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

A phrase such as "an aspect" does not imply that such aspect is essential to the subject technology or that such aspect applies to all configurations of the subject technology. A disclosure relating to an aspect may apply to all configurations, or one or more configurations. An aspect may provide one or more examples of the disclosure. A phrase such as "an aspect" may refer to one or more aspects and vice versa. A phrase such as "an embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples of the disclosure. A phrase such "an embodiment" may refer to one or more embodiments and vice versa. A phrase such as "a configuration" does not imply that such configuration is essential to the subject technology or that such configuration applies to all configurations of the subject technology. A disclosure relating to a configuration may apply to all configurations, or one or more configurations. A configuration may provide one or more examples of the disclosure. A phrase such as "a configuration" may refer to one or more configurations and vice versa.

Terms such as "top," "bottom," "front," "rear" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference.

Furthermore, to the extent that the term "include," "have," or the like is used herein, such term is intended to be inclusive in a manner similar to the term "comprise" as "comprise" is interpreted when employed as a transitional word in a claim.

The word "exemplary" is used herein to mean "serving as an example, instance, or illustration." Any embodiment described herein as "exemplary" is not necessarily to be construed as preferred or advantageous over other embodiments.

A reference to an element in the singular is not intended to mean "one and only one" unless specifically stated, but rather "one or more." Pronouns in the masculine (e.g., his) include the feminine and neuter gender (e.g., her and its) and vice versa. The term "some" refers to one or more. Underlined and/or italicized headings and subheadings are used for convenience only, do not limit the subject technology, and are not referred to in connection with the interpretation of the description of the subject technology. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

While certain aspects and embodiments of the subject technology have been described, these have been presented by way of example only, and are not intended to limit the scope of the subject technology. Indeed, the novel methods and systems described herein may be embodied in a variety of other forms without departing from the spirit thereof. The embodiments presented above and their equivalents are intended to cover such forms or modifications as would fall within the scope and spirit of the subject technology.

What is claimed is:

1. An earphone, comprising:

a driver comprising a transducer diaphragm; and a nozzle comprising an internal passage having an inlet opening, an outlet opening, and a wall connecting the inlet opening and the outlet opening, the wall comprising an inner surface within the passage, the inner surface extending from the inlet opening to the outlet opening, the outlet opening being smaller area than the inlet opening, the inner surface being longitudinally convexly curved, based on at least one tractrix, between the inlet opening and the outlet opening, the nozzle attached to the driver with the transducer diaphragm facing the inlet opening and the inlet opening positioned nearer to the diaphragm than is the outlet opening, wherein the transducer diaphragm has an effective area of sound propagation, the effective area having an effective radius, the outlet opening having an outlet radius, the effective radius being longer than the outlet radius, wherein the tractrix is defined according to $$x = a\,\mathrm{sech}^{-1}\left(\frac{y}{a}\right) - \sqrt{a^2 - y^2},$$

wherein:

"a" is substantially equal to the difference in length between the effective radius and the outlet radius;

"x" is measured in a direction parallel to a central axis of sound propagation of the transducer diaphragm; and "y" is measured in a direction normal to the central axis.

2. The earphone of claim 1, wherein the length of the passage along a longitudinal axis of the passage from the inlet opening to the outlet opening is within 20% of a diameter of the transducer diaphragm.

3. The earphone of claim 1, wherein the length of the passage is greater than the diameter of the transducer diaphragm.

4. The earphone of claim 1, wherein a ratio of the effective radius to the outlet radius is between 1.25 and 2.5.

5. The earphone of claim 1, wherein an x-axis of the tractrix is parallel to, and offset from, a central axis of the passage.

6. The earphone of claim 1, wherein a tangent angle of the tractrix at the inlet opening is normal to a central axis of sound propagation of the transducer diaphragm.

7. An earphone, comprising:

a driver comprising a transducer diaphragm; and a nozzle comprising an internal passage having an inlet opening, an outlet opening, and a wall connecting the inlet opening and the outlet opening, the wall comprising an inner surface within the passage, the inner surface extending from the inlet opening to the outlet opening, the outlet opening being smaller area than the inlet opening, all longitudinal arcs of the inner surface being convex, based on at least one tractrix, between the inlet opening and the outlet opening, the nozzle attached to the driver with the transducer diaphragm facing the inlet opening and the inlet opening positioned nearer to the diaphragm than is the outlet opening, wherein the transducer diaphragm has an effective area of sound propagation, the effective area having an effective radius, the outlet opening having an outlet radius, the effective radius being longer than the outlet radius, wherein the tractrix is defined according to $$x = a\,\mathrm{sech}^{-1}\left(\frac{y}{a}\right) - \sqrt{a^2 - y^2},$$

wherein:

"a" is substantially equal to the difference in length between the effective radius and the outlet radius;

"x" is measured in a direction parallel to a central axis of sound propagation of the transducer diaphragm; and "y" is measured in a direction normal to the central axis.

8. The earphone of claim 7, wherein at least a portion of the inner surface is defined by a complete revolution of a tractrix around an axis.

9. The earphone of claim 7, wherein the inner surface is circumferentially and longitudinally contiguous from the inlet opening to the outlet opening.

10. The earphone of claim 7, wherein the inner surface comprises no edge between the inlet opening and the outlet opening.

11. The earphone of claim 7, wherein the tractrix extends from the inlet opening toward the outlet opening.

12. The earphone of claim 7, wherein the tractrix extends to the outlet opening.

13. An earphone, comprising:

a driver comprising a transducer diaphragm; and a nozzle comprising an internal passage having an inlet opening, an outlet opening, and a wall connecting the inlet opening and the outlet opening, the wall comprising an inner surface within the passage, the inner surface extending from the inlet opening to the outlet opening, the outlet opening being smaller area than the inlet opening, the passage extending along a passage axis, wherein any plane including the axis intersects the inner surface at at least two intersection lines, at least a segment of each intersection line having a curvature based on a tractrix, the nozzle attached to the driver with the transducer diaphragm facing the inlet opening and the inlet opening positioned nearer to the diaphragm than is the outlet opening, wherein the transducer diaphragm has an effective area of sound propagation, the effective area having an effective radius, the outlet opening having an outlet radius, the effective radius being longer than the outlet radius, wherein the tractrix is defined according to $$x = a\operatorname{sech}^{-1}\left(\frac{y}{a}\right) - \sqrt{a^2 - y^2},$$

wherein:

"a" is substantially equal to the difference in length between the effective radius and the outlet radius;

"x" is measured in a direction parallel to a central axis of sound propagation of the transducer diaphragm; and "y" is measured in a direction normal to the central axis.

14. The earphone of claim 13, wherein the passage axis forms a non-zero angle with a central axis of sound propagation of the transducer diaphragm.

15. The earphone of claim 13, wherein the passage axis is parallel to a central axis of sound propagation of the transducer diaphragm.

16. The earphone of claim 15, wherein the passage axis is coaxial with the central axis of sound propagation.

17. The earphone of claim 13, wherein the inner surface comprises a cylindrical portion, wherein the cylindrical portion is positioned between the tractrix and the outlet opening.

18. The earphone of claim 13, wherein an area of the inlet opening is at least as large as the effective area, and the inlet opening is substantially the same shape as a perimeter of the effective area.

19. The earphone of claim 13, further comprising a housing member, an ear tip, and a wire, the housing member attached to the nozzle and positioned opposite the nozzle relative to the driver, the ear tip attached to the nozzle and configured to engage an auditory canal of a human ear, and the wire connecting the driver to a connector configured for attachment to a signal source.

* * * * *